US005393321A

United States Patent [19]

Eadie

[11] Patent Number: 5,393,321

[45] Date of Patent: Feb. 28, 1995

[54] METHOD AND APPARATUS FOR PRODUCING STRIP PRODUCTS BY A SPRAY FORMING TECHNIQUE

[75] Inventor: Gordon C. Eadie, Gwent, Wales

[73] Assignee: British Steel PLC, London, England

[21] Appl. No.: 140,158

[22] PCT Filed: Jul. 23, 1992

[86] PCT No.: PCT GB92/01359

§ 371 Date: Oct. 28, 1993

§ 102(e) Date: Oct. 28, 1993

[87] PCT Pub. No.: WO93/03/94

PCT Pub. Date: Feb. 18, 1993

[30] Foreign Application Priority Data

Jul. 27, 1991 [GB] United Kingdom ..... 9116242

[51] Int. Cl.[6] ..... B22F 9/08

[52] U.S. Cl. ..... 75/338; 148/110; 164/46; 164/479

[58] Field of Search ..... 148/307-309, 148/110-113; 75/338; 164/46, 479

[56] References Cited

U.S. PATENT DOCUMENTS

| | | | |
|---|---|---|---|
| 3,278,346 | 10/1966 | Goss | 148/307 |
| 3,636,579 | 1/1972 | Sakakura et al. | 148/111 |
| 3,670,400 | 7/1972 | Singer | 29/527.5 |
| 3,853,641 | 12/1974 | Sakakura et al. | 148/307 |
| 3,935,038 | 1/1976 | Shimoyama et al. | 148/307 |
| 4,338,143 | 7/1982 | Shimoyama et al. | 148/307 |
| 4,439,251 | 3/1984 | Shimoyama et al. | 148/307 |
| 5,049,205 | 9/1991 | Takahashi et al. | 148/307 |
| 5,305,816 | 4/1994 | Ikawa | 164/46 |

FOREIGN PATENT DOCUMENTS

| | | | |
|---|---|---|---|
| 0429385 | 5/1991 | European Pat. Off. . | |
| 56168938 | 12/1981 | Japan . | |
| 59061551 | 4/1984 | Japan . | |
| 60-33860 | 2/1985 | Japan . | |
| 60-72647 | 4/1985 | Japan . | |
| 2-46956 | 2/1990 | Japan . | |
| 2085779 | 5/1982 | United Kingdom . | |
| 1676747 | 7/1991 | U.S.S.R. | 164/479 |

OTHER PUBLICATIONS

Iron And Steel Engineer, "Process Control Considerations for single-roll Strip Casting of Steel", vol. 65, No. 11, pp 30-35, Nov. 1988.

*Primary Examiner*—George Wyszomierski

*Attorney, Agent, or Firm*—Kinney & Lange

[57] ABSTRACT

A method of producing continuous lengths of metallic strip comprises the steps of forming a spray of molten metal particles, causing the particles to be deposited onto a surface of a hollow receptor roll, rotating and internally heating the receptor roll to form continuous lengths of metallic strip, holding the deposited particles in contact with the receptor roll surface by means of a roll positioned immediately upstream of the knife in the direction of rotation of the receptor roll, and peeling from the receptor roll surface such continuous lengths of metallic strip by means of a knife positioned adjacent to or in contact with the receptor roll surface. Apparatus for performing this process is also disclosed.

25 Claims, 2 Drawing Sheets

METHOD AND APPARATUS FOR PRODUCING STRIP PRODUCTS BY A SPRAY FORMING TECHNIQUE

BACKGROUND OF THE INVENTION

This invention relates to apparatus for and a continuous method of producing strip or sheet (hereinafter referred to simply as "strip") by a spray forming technique in which a plume or spray of metallic particles or droplets at elevated temperatures is deposited onto a suitably shaped receptor surface and removed therefrom in strip form.

In one particular method of spray forming, a stream of molten metal falling freely under gravity is atomised by a system of high pressure jets to form the required plume or spray of droplets which, when they impinge on the suitably shaped receptor under appropriate conditions build up to form a solid artefact for subsequent hot compaction as required.

Hitherto, it has been possible to produce sheets or plates of relatively thick section by such methods: however the correct conditions for the continuous production of near-to-final thickness strip have not been established.

Spray forming techniques can be used to produce a wide variety of metallic strips of different compositions. Such techniques do, however, have particular application to the continuous production of electrotechnical steels.

As is well known, the operation of transformers, motors, generators and like electrical machines depends upon the phenomenon of electromagnetic induction whereby current changes occurring in a (primary) coil are linked magnetically with a proximate (secondary) coil to cause a corresponding voltage to develop across the secondary winding, the value of which depends on the ratio of primary to secondary turns. The magnetic linkage effect is multiplied by many orders if the windings are formed upon a circuit of ferrous material so greatly enhancing the efficiency of the machine. As the current in the primary coil changes to establish a magnetic flux in the core, small currents called eddy or Foucault currents flow in the core material itself in a plane normal to the direction of the magnetic flux established in the core. Thus, if primary coil current is changing at, say, mains frequency (50 Hz), these eddy currents cause heating of the core material which is electrically conducting. Such heating effects are related in magnitude to the second power of the exciting frequency and represent power lost to the machine system. Therefore every effort is made to reduce the eddy currents. Two approaches are employed viz (a) make up the core from laminated sheet, each layer being typically 0.30 mm thick and both surfaces carrying a very thin (micron) layer of electrical insulant;

(b) increase the intrinsic resistivity of the material itself.

We are aware, of course, that total power loss in a machine system has a second component, the hysteresis loss, and that this is dealt with by developing the grain structure of the core material so that in grain size and orientation magnetic domains of favourable form are engendered within each grain and thus improve the flux carrying capacity of the material with least loss of energy manifesting itself as wasteful heat.

To those skilled in the art, it has long been known that the addition of silicon and aluminium to iron produces a wide range of electrotechnical steel strip incorporating these features and from which machine cores can be assembled. However, even the best known conventional steelmaking techniques are limited in the amount of material such as silicon and/or aluminium which can be added to iron to increase the electrical specific resistance of the ensuing material or improve the grain structure and hence domain dynamics because the addition of such elements causes the material to become so brittle as to prevent working due to a coarse grain formation. The presence in the material of silicon-/aluminium in quantities of above about 3.25% means that the material cannot be cold reduced without the onset of cracking. Cold reduction is required for economic production and also to develop desired properties in important grades of electrotechnical steels as well as to improve surface quality.

Attempts have been made to overcome these problems by the production of amorphous (non-crystalline) material by melt spinning processes but these materials are, to date, very thin as spun (about 40 micron max) and extremely brittle rendering them inappropriate for assembly into very large electrical machines.

Therefore, the application of the spray forming technique to the continuous production of electrotechnical steel strip presents itself as a possible means of producing material comparable in mechanical handling to conventional material but with enhanced resistivity and/or grain/domain structure due to the fact that the spray forming technique permits the addition of silicon-/aluminium to levels far beyond those possible with conventional techniques while still retaining a small grain size or permits the formation of alloys not possible by conventional processing due to, for example, segregation.

It is an object of the present invention to provide apparatus for and methods of producing strip continuously by a strip forming process which at least alleviates disadvantages present in previous techniques. More especially, but not exclusively, it is an object of this invention to provide apparatus and methods by which electrotechnical steel strip of enhanced magnetic performance can be produced continuously by spray forming.

The invention also sets out to demonstrate other benefits which accrue from the use of the technique to be described such as re-use of scrap material, use of compositions (alloys) with interesting magnetic properties hitherto prohibited by phase diagram limitations etc.

SUMMARY OF THE INVENTION

According to the present invention in one aspect there is provided apparatus for producing strip which comprises atomising means for producing a spray of metallic particles or droplets at elevated temperatures, a hollow receptor roll positioned below the atomising means on which the metallic particles or droplets are received and heating means positioned within the interior of the receptor roll and operable to vary in a controlled manner the temperature of the external surface of the receptor roll on which the metallic particles or droplets are deposited.

The heating means preferably comprises furnace elements positioned within the body of the receptor roll The receptor roll may be produced from cast iron or mild steel and its wall thickness is selected to provide dimensional stability whilst minimising thermal mass to achieve rapid thermal response to temperature variations required during use. Typically, the wall thickness of the receptor wall lies in the range 0.64 to 3.18 cm.

The receptor roll may be supported on a bearing cantilevered from one side of a supporting framework, the framework supporting from its opposite side a cantilevered support for the furnace elements.

The atomising means, receptor roll, furnace elements and framework are preferably enclosed within a gas-tight chamber. The chamber may be provided with gas tight glands to permit the entry of drive shafts for the receptor roll.

The atomising means may comprise an array of nozzles connected to direct a plurality of gas jets onto the outer circumference of a stream of molten metal falling freely under gravity or pushed from an outlet nozzle of a crucible or the like. The crucible may be housed within an induction or resistance furnace positioned above the atomising means.

A rigid knife with its blade in contact with the surface of the receptor roll may be provided to remove deposited material in strip form from the surface of the receptor roll. The angle of attack of the blade of the knife relative to the vertical may lie within the range 25° to 60°. The knife may be positioned a short distance above the horizontal diameter of the receptor roll, this distance typically being between 2.54 and 10.16 cm for a roll of approximately 22.86 cm in outside diameter. A weighted roll with its axis generally parallel to that of the receptor roll may be positioned immediately above the knife to hold the deposited material onto the surface of the receptor roll before it is acted upon by the knife. For a receptor roll of approximately 22.86 cm outside diameter, the weighted roll is typically between 2.54 and 12.7 cm diameter.

Strip material leaving the receptor wall may be fed continuously to an induction furnace for reheating to a temperature (typically between 900° and 1300° C.). On leaving the reheat furnace, the strip may be compacted to the required density between compaction rolls.

In another aspect, the invention provides a method of producing continuous lengths of metallic strip in which a spray of molten metal particles are deposited onto the surface of an internally heated hollow receptor roll and peeled from the receptor roll surface by means of a knife positioned adjacent to or in contact with the receptor roll surface, the deposited material being held in contact with the roll surface by means of a roll positioned immediately upstream of the knife in the direction of rotation of the roll.

The spray of molten metal particles is preferably produced by directing a plurality of jets of gas onto a stream of molten metal falling freely under gravity or pushed from a tundish, crucible or the like. The atomising gas may comprise helium, argon or the like. The molten metal may be superheated prior to teeming.

At the start of the process, a metallic Judas strip may be positioned on the surface of the receptor roll to receive the initially atomised material. The surface of the Judas strip may be toughened, e.g. by shot blasting. The Judas strip and sprayed material deposited thereon is subsequently pulled over the surface of the receptor roll to be removed therefrom. Alternatively, or additionally, the surface of the receptor roll (or a part thereof) is coated with a dried layer of, for example, colloidal silica after shot blasting. Rotation of the receptor roll is delayed for a short period of time at the start of the atomisation process to enable an initial build up of deposited material.

In a further aspect, the invention provides strip material produced by the method exemplified in the preceding paragraphs.

BRIEF DESCRIPTION OF THE DRAWINGS

The invention will now be described, by way of example only, with reference to the accompanying diagrammatic drawing in which.

DETAILED DESCRIPTION OF THE PREFERRED EMBODIMENTS

For the purposes of this particular description, reference will be made to the production of non-oriented electrical steel which, by conventional processing routes, is typically distinguished by having a combined silicon-aluminium content of between 3 and 3.25% by weight. It will be appreciated, however, that the apparatus illustrated can be employed to produce a wide range of other materials with higher levels of alloying constituents.

Figure 1:
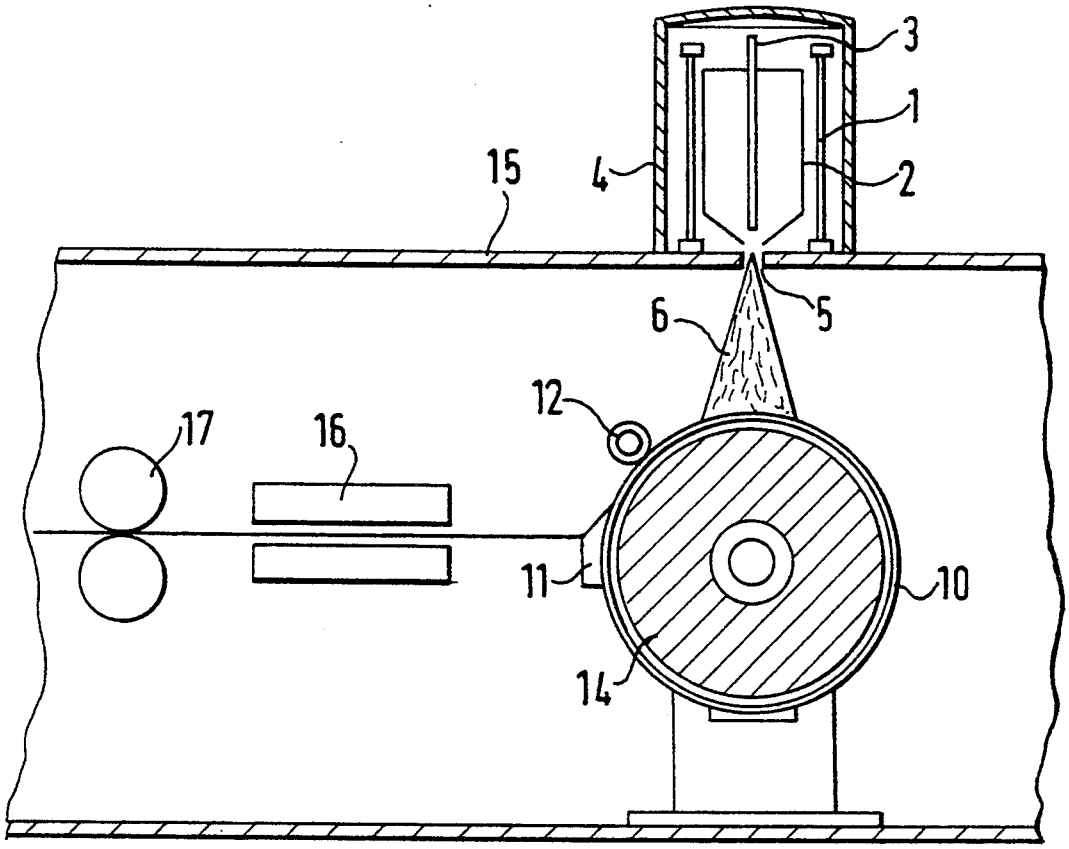
FIG. 1 schematically illustrates apparatus in accordance with the invention.

The apparatus illustrated in FIG. 1 includes an induction or resistance furnace 1, housing a crucible 2 in which a melt of a carbon free electrical steel scrap or virgin melt material is produced. The furnace is constructed end insulated to avoid carbon pick-up in the melt. The crucible 2 is fitted with an hollow stopper rod 3 suitably equipped to carry a thermocouple so positioned within the stopper rod that its junction is sited at the centre of the melt to ensure that the temperature of the mass of the melt is accurately recorded. The stopper rod 3 and thermocouple can be selectively raised, preferably electromagnetically, to permit egress of melted metal through an orifice formed in the bottom of the crucible 2.

The whole of the furnace assembly is contained within a stainless steel cheer 4 fitted with gas tight upper and lower water cooled jackets. To assist the egress of molten metal the chamber is supplied with a controllable gas pressure. A pressure of 0.2 to 0,6 bar is typical. The melting chamber is lined internally with a non-carbonaceous heat insulant material. The lower water jacket is fitted with a centrally disposed plug 5 in which seats a ceramic cone nozzle capable of sustaining very high temperatures (e.g. a nozzle produced from boron nitride) and connected to the outlet of the crucible 2 by a heated refractory guide tube of typically 2.5 to 5 mm internal diameter. The plug 5 carries an array of finely machined and shaped orifices from which gas under pressure is directed onto the stream of molten metal emerging from the crucible 2 to produce a conical spray of atomised metal 6 of typically 30° or 15° included half angle. The atomising jet orifices are connected to be supplied with dry impurity-free non-oxidising atomisation gas; bottled helium or argon are suitable gases although various types of electrotechnical steel processing annealing gas properly dried, clean and compressed would also be suitable.

Situated at a suitable distance (typically 15.24 cm) below the orifice is located the surface of an internally heated receptor roll 10 whose outside diameter is typically of the order of 22.86 cm. The axis of the receptor roll 10 is horizontal and the roll is supported in a frame which also carries a rigid 'knife' 11, the blade of which lies in contact with or closely adjacent to the surface of the receptor roll 10 and its function is to peel off metal deposited onto the surface of the receptor roll 10 in the form of a continuous strip. To assist the peeling action, a weighted small diameter roll 12, typically of 5.08 cm in diameter and with its axis parallel to the axis of the receptor roll, 10, is sited immediately above the knife blade 11 so that emergent peeled material is held down on to the peeling edge of the knife.

Apart from assisting the peeling action of the knife, the roll 12 holds the emergent material in close contact with the surface of the receptor roll 10 to prevent the material from peeling backwards to the point of deposition on the receptor roll 10 and thereby causing a discontinuity or other damage to the emergent material. The positioning of the knife 11 relative to the horizontal diameter of the roll 10 and the angle of the peeling edge of the knife 11 are important. Typically, the knife is set to give a peeling line 3.81 cm above the horizontal diameter of the receptor roll and the included angle of the knife blade is from 25° to 60°. The angle of attack of the knife blade relative to the vertical is typically from 3° to 5°.

The receptor roll 10 is hollow so as to be of low thermal mass and therefore able to respond quickly to heat input supplied from furnace elements 14 contained in the body of the roll. While it is possible to use a mild steel receptor roll 10, best results have been achieved with a cast iron roll. The thickness of the wall of the hollow receptor roll 10 is typically approximately 1.5 cm. This affords strength and dimensional stability to the roll while keeping the thermal mass low to achieve rapid thermal response to heating and cooling as may be required during processing. To achieve this end, one bearing cantilevered from one side of the framework carries the receptor roll 10 shell while the opposite side of the framework carries the cantilevered support and wiring of the furnace which is also fitted with a thermocouple. The purpose of the furnace elements 14 is to heat the surface of the receptor roll 10 to provide for a degree of control of the metal deposition conditions.

The whole of the receptor roll 10, furnace elements 14, framework etc is enclosed in shielding and the entire assembly from the water cooling bulkhead below the melting furnace is also contained in a second gas-tight stainless steel chamber 15 fitted with a cyclone and receiver to remove overspray arising from the deposition process.

Penetrating the walls of this lower chamber are gas-tight glands which permit electric drive shafts to enter the chamber and rotate the receptor roll 10 so as to make possible a continuous process of spray deposition and peeling off from the surface of the receptor roll 10 of the contents of the upper furnace crucible.

The peeled material is guided into an orifice in the wall of the deposition chamber and thence into a flat bed high energy input induction furnace 16 of short length to reheat the peeled material prior to entry into yet another stainless steel sealed vessel inside which is a set of driven compaction rolls 17. The purpose of the rolls 17 is to ensure 100% density of the emergent material which is then coiled. Also, provision is made within this second chamber for a receptacle to catch the emergent stream of metal before atomisation is established. As soon as atomisation of the metal stream is established, this vessel can, by means of an arm rotating through a gland, be swung out of the way of the atomised stream.

In operation of the apparatus described a furnace charge of carbon free electrolytic iron and ferro-silicon is prepared so that the ensuing composition will be typically 4.2% silicon by weight with the balance iron.

The melting furnace is charged and all the equipment chambers are sealed and evacuated to remove air. The entire apparatus is flushed with argon (or other appropriate gas). The furnace is programmed to give a suitable melting regime and, by means of the thermocouple inside the stopper rod 3, the progress of the melt can be monitored. When the melting point of the charge has been reached (about 1500° C.), the heating process is continued until the melt has attained about 1650° C. or alternatively, about 150° C.–200° C. superheat. The purpose of the superheat is to keep the metal liquid until it emerges from the lower nozzle-into the atomising gas steam. Controlled delivery of the metal from the furnace 1 is further assisted by the establishment of a positive gas pressure in the upper chamber of about 0.3–0.5 bar.

Once a stream of metal is teeming freely into a catcher device positioned below the crucible nozzle. the atomising gas is turned on at about 17 bar whereupon the spray jet is established and the catcher device swung out of the way.

At this stage the spray does not fall upon the receptor roll 10 but upon an initially stationary lead strip of annealed (to render it pliable) thin gauge electrotechnical steel strip which has been shot blasted with grit and fed through the entire apparatus. The drives are set in motion and the lead strip now being covered with a spray deposited layer of metal is drawn through the system. When the end of the lead strip passes over the receptor roll 10, the surface of which has also been shot blasted, the spray impinges directly on the surface of the receptor roll and the material thus formed is pulled through the system. The receptor roll surface is heated by the receptor roll furnace to maintain the deposited material at about 600° C. to prevent chilling. Provision is made to lift the compaction rolls to permit the lead strip to pass and then the roll gap is reduced to the desired gauge. On being removed from the roll 10 by the knife 11 and cracker roll 12, the as-sprayed strip is re-heated to about 900°–1000° C. in the flat bed induction furnace 16 and thereby rendered soft enough to compact to provide material with two-good surfaces after passage through the compaction rolls 17. It has been found that the use of a lead strip can be avoided by providing shaped plain surfaced sheet metal guides to carry the as-sprayed material into the re-heat furnace and thence to the compaction rolls and to the coiler grip. An alternative arrangement can also be used whereby the guides consist of broad linked chain.

It has also been found that the process can be initiated without the use of a lead strip by coating the receptor roll 10 with a dried layer of colloidal silica after shot blasting. Before deposition starts the receptor roll is given a half revolution to present a hot section of surface to the jet and then letting the atomised stream dwell on the receptor roll 10 for about 4 seconds at the start of atomisation before causing the receptor roll 10 to rotate.

The short period of static desposition provides a thickened initial edge for the knife 11 to plough under and prise away from the surface of the receptor roll 10.

The speed of rotation of the receptor roll 10, guide and compaction rolls and coiler determines the as-sprayed thickness of the strip which is related to the final thickness by about 50% reduction and, typically, a through speed of about 2.54 cm per second produces an as-sprayed thickness of 2–3 mm using a 2.5 mm guide tube and the abovementioned pushing and atomisation pressures.

The width of the strip deposited under these conditions varies with the rate of metal delivery, size of guide tube, included angle of spray cone or plume and whether or not a scanning atomiser has been employed to achieve flatter strip of 15.24 cm width or greater.

As the metal droplets impinge on the receptor roll a porous layer is contructed but as further droplets impinge, a "Splatting" action is introduced whereby the semi-liquid droplets virtually merge with one another but cool so rapidly that no time is accorded for large grains to form such as would be the case if strip of the same composition had been prepared by conventional processes. Also, due to the fact that atomisation produces a droplet spread with a mean size of between 50 and 200 micron (preferably about 80 to 100 micron), this is small enough to permit the final strip to be cold rolled to produce good surfaces and exact gauges or merely cold skin-passed if desired. A porous layer is also formed on the upper surface due to entrainment of atomising gas and, since the upper surface is not in contact with any substrate, the surface texture is very rough. However, all these defects are removed by hot compaction.

Time of flight and velocity of the various particle sizes contained in the spray or plume are influenced by the pushing and atomising pressures, the size of the guide tube or exit nozzle, the nature of the atomising gas, whether or not scanning is employed and the magnitude of the separation distance between emergent jet and receptor surface. It should be noted that the atomising gas velocity is very high and it is necessary that the diameter of the vessel in which desposition is proceeding is large enough to avoid turbulence or buffeting which will disturb the spray or plume and produce malformed material. The high speed gas also causes very rapid cooling and therefore the quantities of gas used should be as small as possible.

In brief, for a system to produce strip continuously, what is required is a means of causing a receptor surface to intersect a coned plume of atomised particles at a suitable distance from the plume source, for this surface to be continuously renewed, maintained at a suitable temperature and for the deposited material to be removed and compacted. The procedures described above fulfil these requirements and strip may thus be produced continuously.

Figure 4:
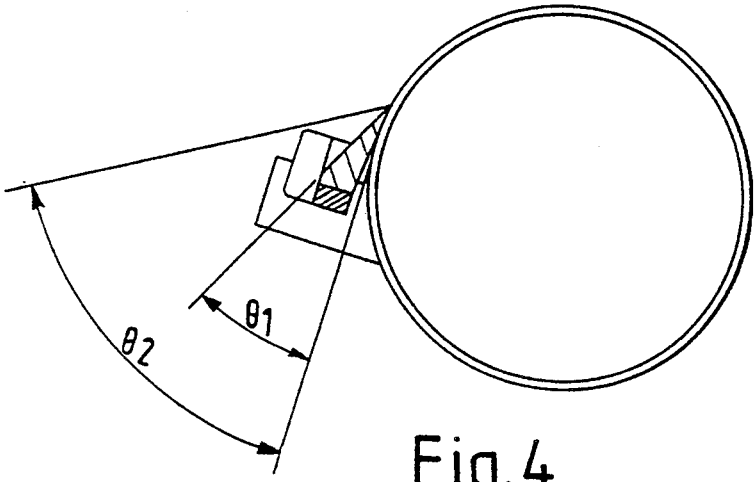
FIG. 4 is an enlarged view of a knife and receptor roll in accordance with the invention
Figure 2:
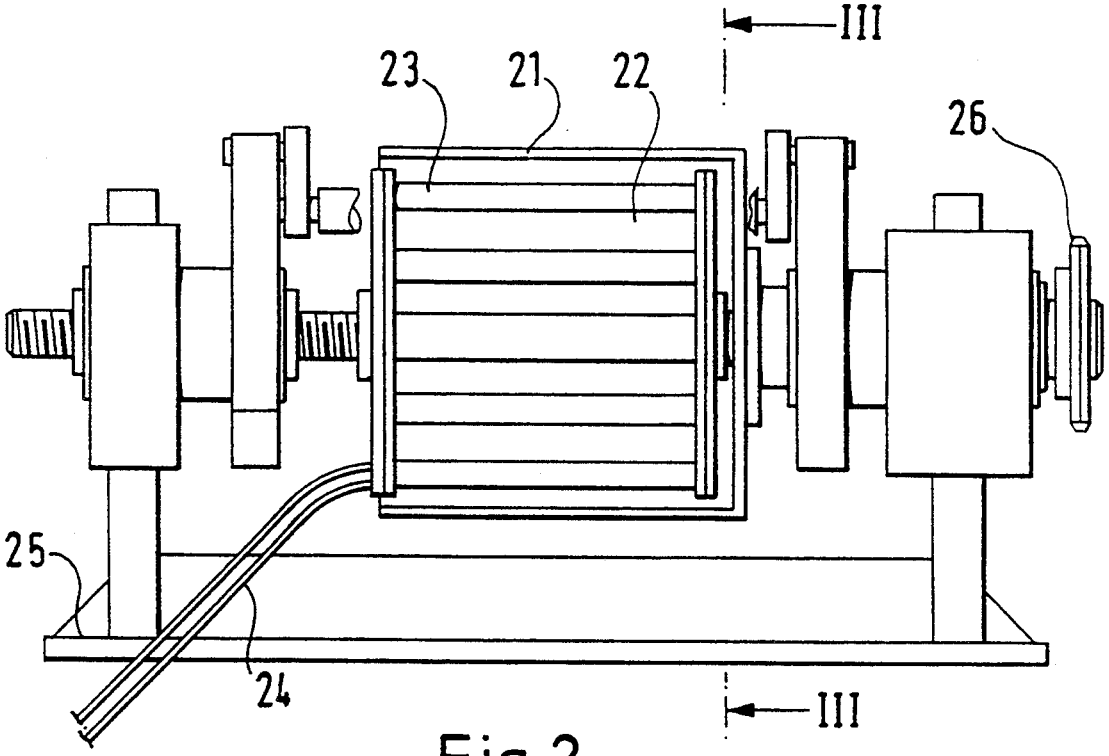
FIG. 2 is a side view partly in section of a receptor roll in accordance with the invention.
Figure 3:
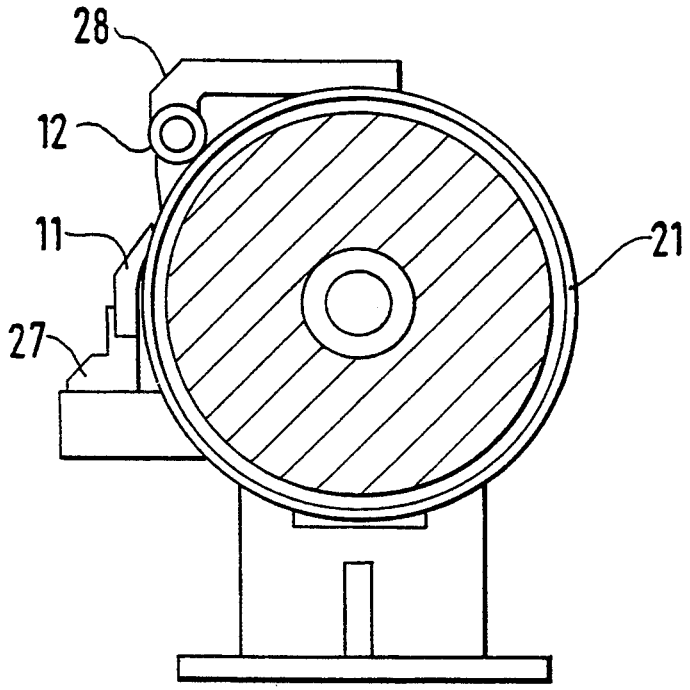
FIG. 3 is a section taken along line III—III of FIG. 2.

The receptor roll 10 is illustrated in greater detail in FIGS. 2 and 3 of the drawings. As shown, the outer shell 21 of the roll houses an electrical heater 22 comprising a plurality of heating tubes 23 which span across the full width of the roll 10. The tubes 23 are supplied with electricity by means of a cable 24. The roll 10 is mounted on a stand 25 and is driven through a drive sprocket 26. The relative positions of the peeling knife 11 and weighted roll 12 are shown more clearly in FIG. 3. As will be seen from this Figure, the knife 11 is mounted in a holder 27 positioned to one side of the roll 10 and the weighted roller 12 is carried by a resiliently mounted arm.28 positioned above the roll 10. As will be seen from FIG. 4, the included angle of the blade of the knife 11 may vary between 25° and 60°. Other variables include the actual point of peeling, the peeled strip width and thickness, the strip tension, the strip temperature and composition, and the roll diameter.

From the foregoing it will be readily appreciated that this system can be employed to produce alloys with desirable magnetic and other properties of the type 13–16% aluminium balance iron which would not be possible to roll or work commercially unless by the method of continuous strip production by spray forming.

It will be appreciated that the foregoing is exemplary of methods and apparatus in accordance with the inventions and that modifications can readily be made thereto without departing from the true scope of the invention.

What is claimed is:

1. An apparatus for producing strip comprising:

atomizing means for producing a spray of metallic particles or droplets at elevated temperatures;

a hollow receptor roll positioned below the atomizing means on which the metallic particles or droplets are received; and heating means positioned within an interior of the receptor roll and operable to apply heat to an external surface of the receptor roll on which the metallic particles or droplets are deposited.

2. The apparatus as claimed in claim 1, wherein the heating means comprises furnace elements positioned within the interior of the receptor roll.

3. The apparatus as claimed in claim 2, wherein the receptor roll is supported on a bearing cantilevered from one side of a supporting framework, the framework supporting from its opposite side a cantilevered support for the furnace elements.

4. The apparatus as claimed in claim 3, wherein the atomizing means, receptor roll, furnace elements and framework are enclosed within a gas-tight chamber.

5. The apparatus as claimed in claim 4, wherein the chamber is provided with gas tight glands to permit the entry of drive shafts for the receptor roll.

6. The apparatus as claimed in claim 1, wherein the receptor roll comprises cast iron and its wall thickness lies in the range 0.64 to 3.18 cm.

7. The apparatus as claimed in claim 1, wherein the receptor roll comprises mild steel and its wall thickness lies in the range 0.64 to 3.18 cm.

8. The apparatus as claimed in claim 1, wherein the atomizing means comprises an array of nozzles connected to direct a plurality of gas jets onto the outer circumference of a stream of molten metal leaving an outlet nozzle of a crucible.

9. The apparatus as claimed in claim 8, wherein the crucible is housed within an induction furnace positioned above the atomizing means.

10. The apparatus as claimed in claim 8, wherein the crucible is housed within a resistance furnace positioned above the atomizing means.

11. The apparatus as claimed in claim 1, further comprising a rigid knife with its blade in contact with the surface of the receptor roll to remove deposited material in strip form from the surface of the receptor roll.

12. The apparatus as claimed in claim 11, wherein the angle of attack of the blade of the knife relative to the vertical lies within the range 25° to 60°.

13. The apparatus as claimed in claim 11, wherein the roll has an outside diameter of approximately 22.86 cm and the knife is positioned above the horizontal diameter of the receptor roll a distance of between 2.54 and 10.16 cm.

14. The apparatus as claimed in claim 11, further comprising a weighted roll with its axis generally parallel to that of the receptor roll positioned immediately above the knife to hold the deposited material onto the surface of the receptor roll before it is acted upon by the knife.

15. The apparatus as claimed in claim 14, wherein the weighted roll is of between 2.54 and 12.7 cm in diameter.

16. The apparatus as claimed in claim 1, further comprising an induction furnace for reheating strip material leaving the receptor roll to a temperature of between 900° and 1300° C.

17. The apparatus as claimed in claim 16, further comprising compaction rolls for compacting strip material leaving the reheat furnace.

18. A method of producing continuous lengths of metallic strip comprising the steps of:

forming a spray of molten metal particles;

causing the particles to be deposited onto a surface of a hollow receptor roll;

rotating and internally heating the receptor roll to form continuous lengths of metallic strip;

holding the deposited particles in contact with the receptor roll surface by means of a roll positioned immediately upstream of the knife in the direction of rotation of the receptor roll; and peeling from the receptor roll surface such continuous lengths of metallic strip by means of a knife positioned adjacent to or in contact with the receptor roll surface.

19. The method as claimed in claim 18, wherein the spray of molten metal particles is produced by directing a plurality of jets of gas onto a stream of molten metal leaving a crucible.

20. The method as claimed in claim 19, wherein the atomizing gas is an inert gas.

21. The method as claimed in claim 19, comprising the step of super heating the molten metal prior to forming the spray.

22. The method as claimed in claim 19, further comprising the step of positioning metallic strip on the surface of the receptor roll to receive the deposited particles.

23. The method as claimed in claim 22, further comprising the step of roughening the surface of the metallic strip and, after deposition of sprayed metal particles thereon, pulling the metallic strip over the surface of the receptor roll.

24. A method as claimed in claim 22, further comprising the step of delaying rotation of the receptor roll for a short period of time to enable an initial build up of deposited metal on the metallic strip.

25. A method as claimed in claim 19, further comprising the step of coating at least a part of the surface of the receptor roll with a dried layer of colloidal silica.

* * * * *

UNITED STATES PATENT AND TRADEMARK OFFICE

CERTIFICATE OF CORRECTION

PATENT NO. : 5,393,321
DATED : February 28, 1995
INVENTOR(S) : Gordon C. Eadie

It is certified that error appears in the above-indentified patent and that said Letters Patent is hereby corrected as shown below:

Col. 3, line 6, delete "cantilevered", insert --cantilevered--

Signed and Sealed this

Eleventh Day of July, 1995

*Attest:*

Bruce Lehman

BRUCE LEHMAN

*Attesting Officer*

*Commissioner of Patents and Trademarks*